US005846118A

United States Patent [19]

Wu

[11] Patent Number: 5,846,118

[45] Date of Patent: Dec. 8, 1998

[54] PORTABLE LUMINOUS TOY

[76] Inventor: Teng-Hui Wu, 58, Ma Yuan West St., Taichung, Taiwan

[21] Appl. No.: 935,992

[22] Filed: Sep. 23, 1997

[51] Int. Cl.[6] ..... A63H 33/00

[52] U.S. Cl. ..... 446/220; 446/219

[58] Field of Search ..... 446/219, 220, 446/222

[56] References Cited

U.S. PATENT DOCUMENTS

| | | | |
|---|---|---|---|
| 3,432,904 | 3/1969 | Stewart | 446/220 |
| 3,539,794 | 11/1970 | Mckay et al. | 446/219 |
| 3,900,989 | 8/1975 | Weisenthal | 446/222 |
| 4,015,111 | 3/1977 | Spector | 446/220 |
| 4,721,491 | 1/1988 | Buchanan | 446/222 |
| 4,781,645 | 11/1988 | Kato | 446/221 |
| 4,884,990 | 12/1989 | Lovik | 446/219 |
| 4,898,561 | 2/1990 | Nottingham et al. | 446/220 |
| 4,929,214 | 5/1990 | Liebermann | 446/221 |

FOREIGN PATENT DOCUMENTS

| | | | |
|---|---|---|---|
| 2272170 | 5/1994 | United Kingdom | 446/220 |

*Primary Examiner*—Robert A. Hafer
*Assistant Examiner*—Jeffrey D. Carlson

[57] ABSTRACT

A portable luminous toy has a support rod and a hollow main body connected to the support rod. The main body has a lug. The lug has a through hole. The support rod has a distal end disposed on a first end of the support rod, and a first end cover and a second end cover disposed on a second end of the support rod. The first end cover couples with the second end cover. The first end cover has a post. The second end cover has a center hole. A hollow rivet is inserted in the center hole via the through hole. The post is inserted in the hollow rivet and the center hole. A plurality of baking soda troches are disposed in the main body. A film bag is disposed in the main body. The film bag contains an acidic solution. A plastic bag is disposed in the main body. The plastic bag has a transparent film. The plastic bag contains a luminous liquid.

2 Claims, 11 Drawing Sheets

PORTABLE LUMINOUS TOY

BACKGROUND OF THE INVENTION

The present invention relates to a portable luminous toy. More particularly, the present invention relates to a portable luminous toy which can be inflated automatically.

Most conventional inflated toys should be inflated by a mouth of a user. Some conventional inflated toys can be inflated by an inflation device.

SUMMARY OF THE INVENTION

An object of the present invention is to provide a portable luminous toy which can be inflated automatically.

In accordance with a first embodiment of the present invention, a portable luminous toy comprises a support rod and a hollow main body connected to the support rod. The main body has a lug. The lug has a through hole. The support rod has a distal end disposed on a first end of the support rod, and a first end cover and a second end cover disposed on a second end of the support rod. The first end cover couples with the second end cover. The first end cover has a post. The second end cover has a center hole. A hollow rivet is inserted in the center hole via the through hole. The post is inserted in the hollow rivet and the center hole. A plurality of baking soda troches are disposed in the main body. A film bag is disposed in the main body. The film bag contains an acidic solution. A plastic bag is disposed in the main body. The plastic bag has a transparent film. The plastic bag contains a luminous liquid.

In accordance with a second embodiment of the present invention, a portable luminous toy comprises a support rod and a hollow main body connected to the support rod. The main body has a pattern. The support rod has a distal end disposed on a first end of the support rod, and a light-emitted diode and a luminous circuit disposed on a second end of the support rod. A plurality of baking soda troches are disposed in the main body. A film bag is disposed in the main body. The film bag contains an acidic solution. A first wire and a second wire are connected to the luminous circuit. A gel encloses the first wire and the second wire. The main body covers the light-emitted diode, the luminous circuit, and the gel.

Figure 1:
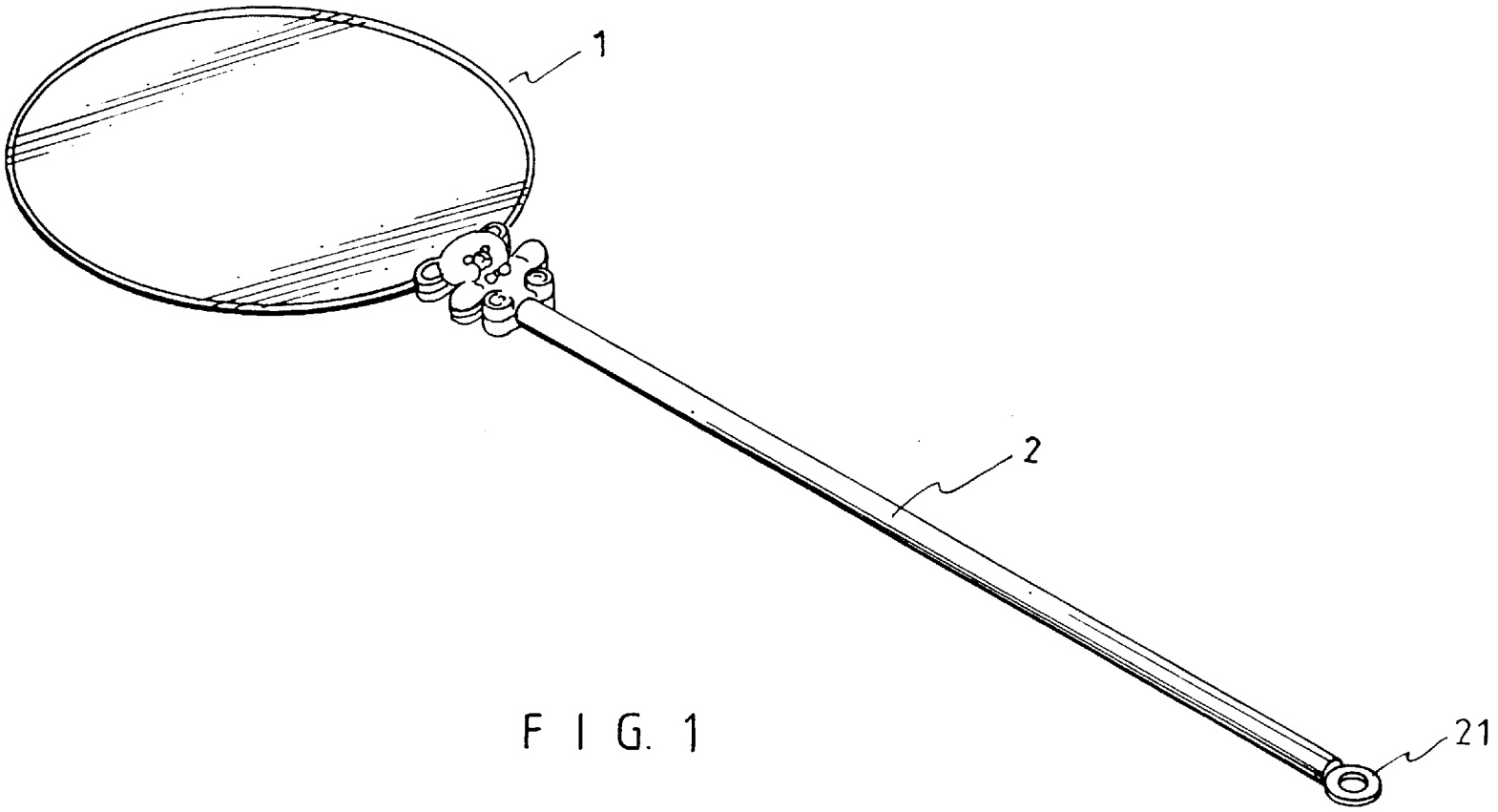
FIG. 1 is a perspective assembly view of a portable luminous toy of a first preferred embodiment in accordance with the present invention.
Figure 2:
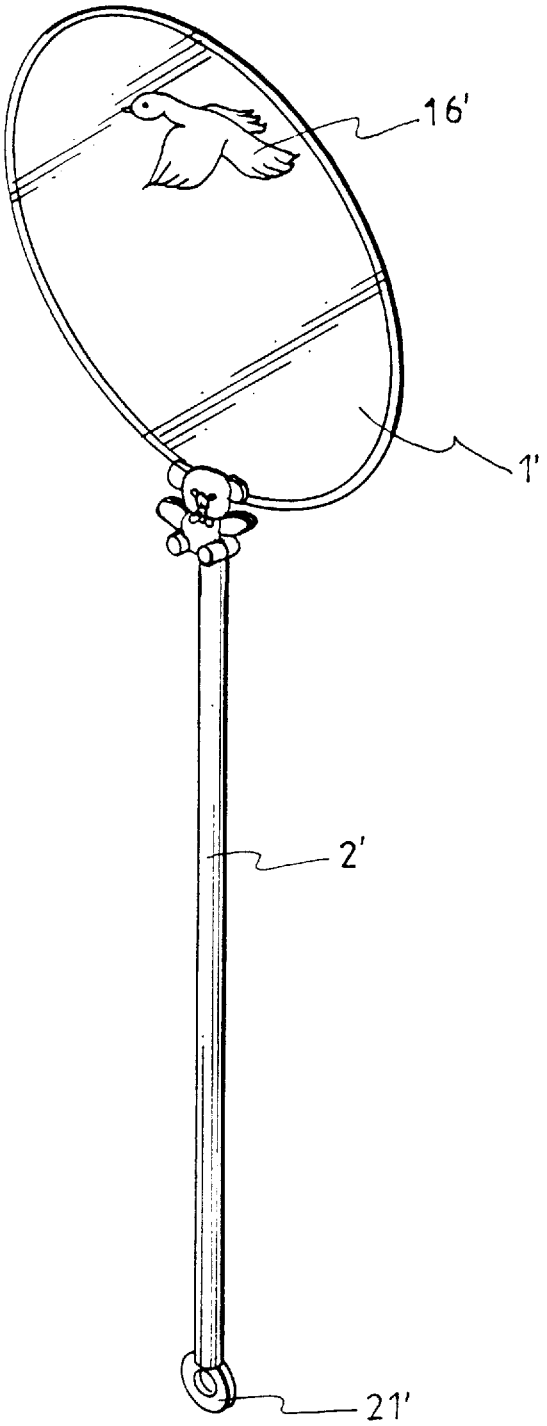
FIG. 2 is a perspective assembly view of a portable luminous toy of a second preferred embodiment in accordance with the present invention.
Figure 3:
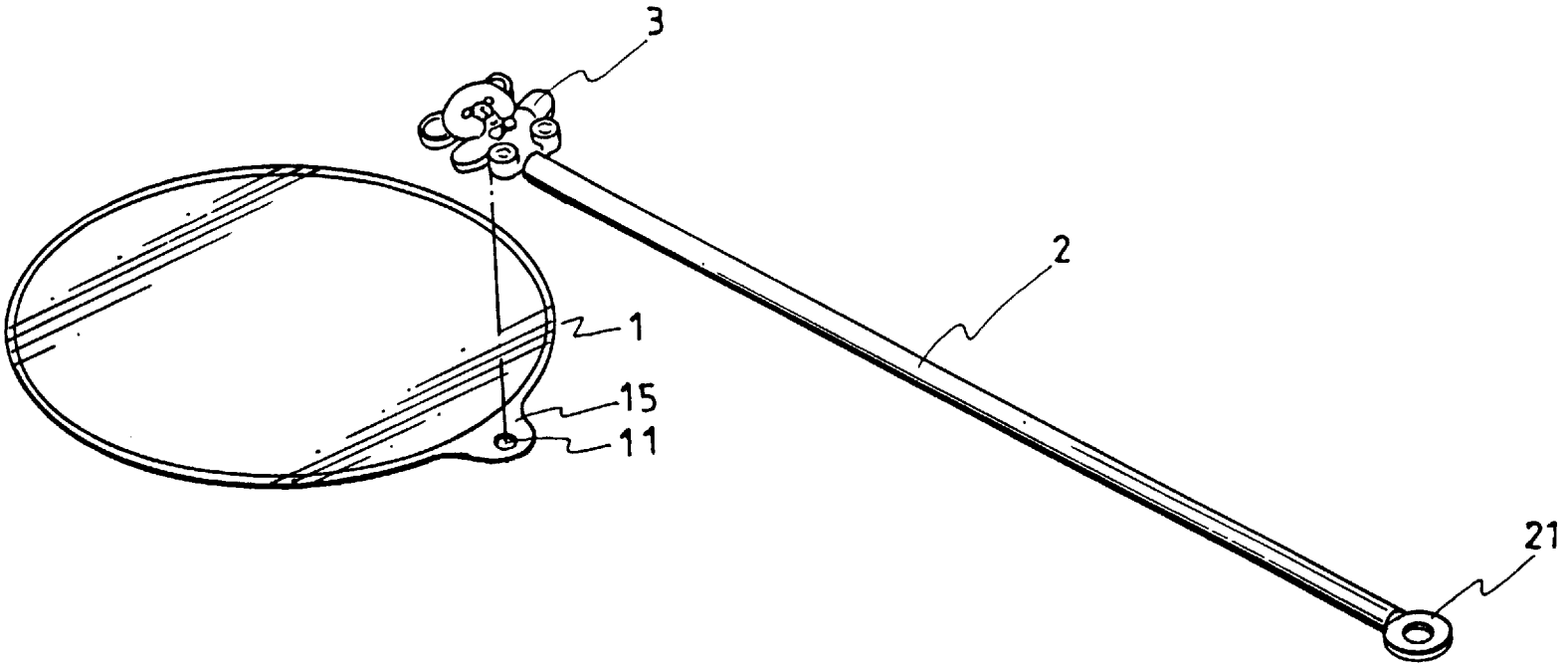
FIG. 3 is a perspective exploded view of a portable luminous toy of a first preferred embodiment in accordance with the present invention.
Figure 3A:
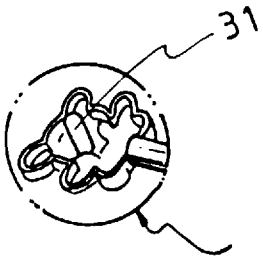
FIG. 3A is a perspective view of a first end cover.
Figure 3B:
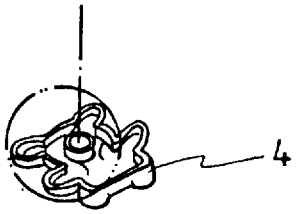
FIG. 3B is a perspective view of a second end cover.
Figure 3C:
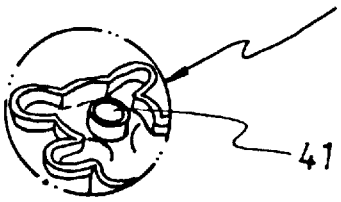
FIG. 3C is a partially perspective view of a second end cover.
Figure 3D:
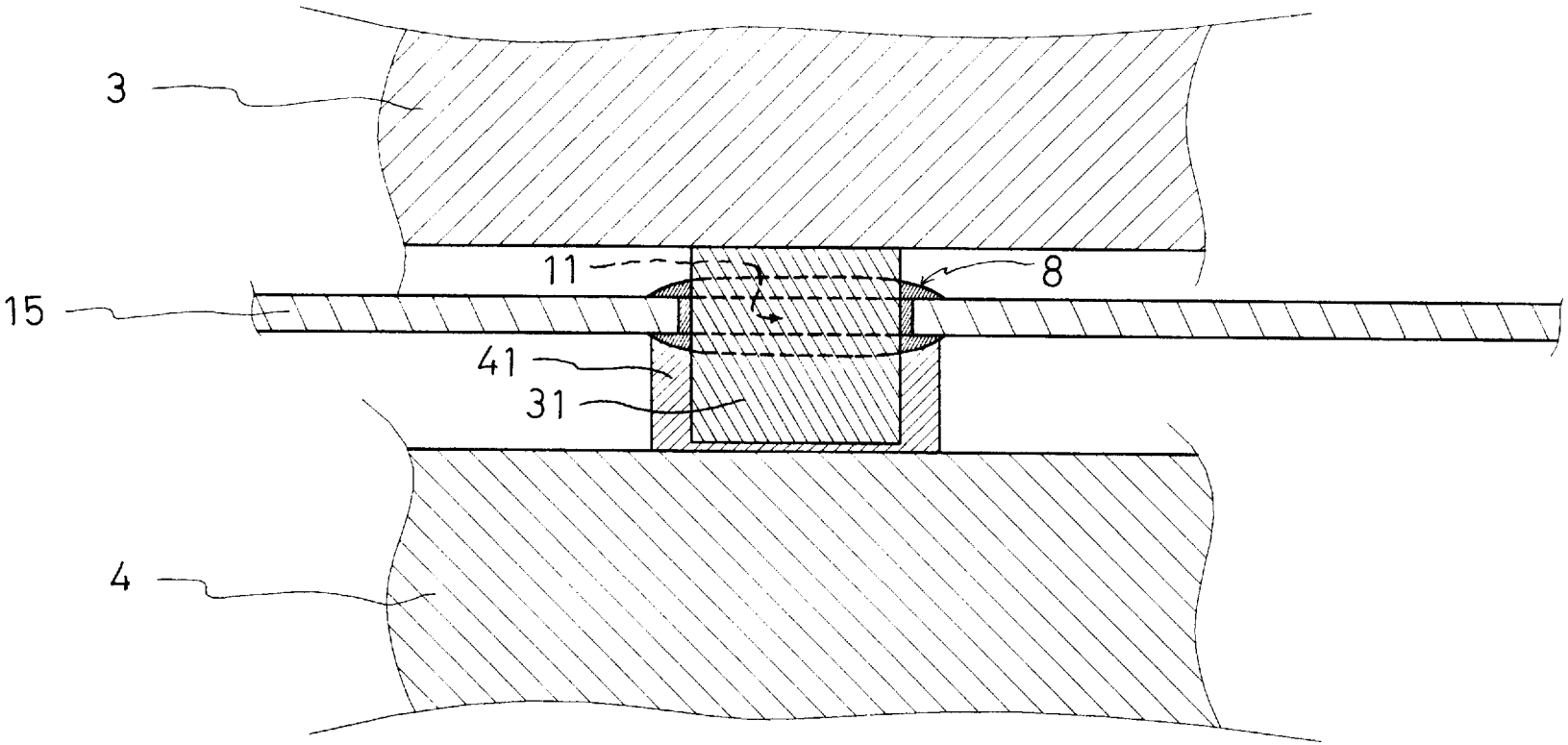
FIG. 3D is a partially sectional assembly view of FIG. 3.

DETAILED DESCRIPTION OF THE INVENTION.

Referring to FIGS. 1, 3, 3A, 3B, 3C, 3D and 4, a first portable luminous toy comprises a support rod 2 and a hollow main body 1 connected to the support rod 2. The main body 1 has a lug 15. The lug 15 has a through hole 11. The support rod 2 has a distal end 21 disposed on a first end of the support rod 2, and a first end cover 3 and a second end cover 4 disposed on a second end of the support rod 2. The first end cover 3 couples with the second end cover 4. The first end cover 3 has a post 31. The second end cover 4 has a center hole 41. A hollow rivet 8 is inserted in the center hole 41 via the through hole 11. The post 31 is inserted in the hollow rivet 8 and the center hole 41.

Figure 4:
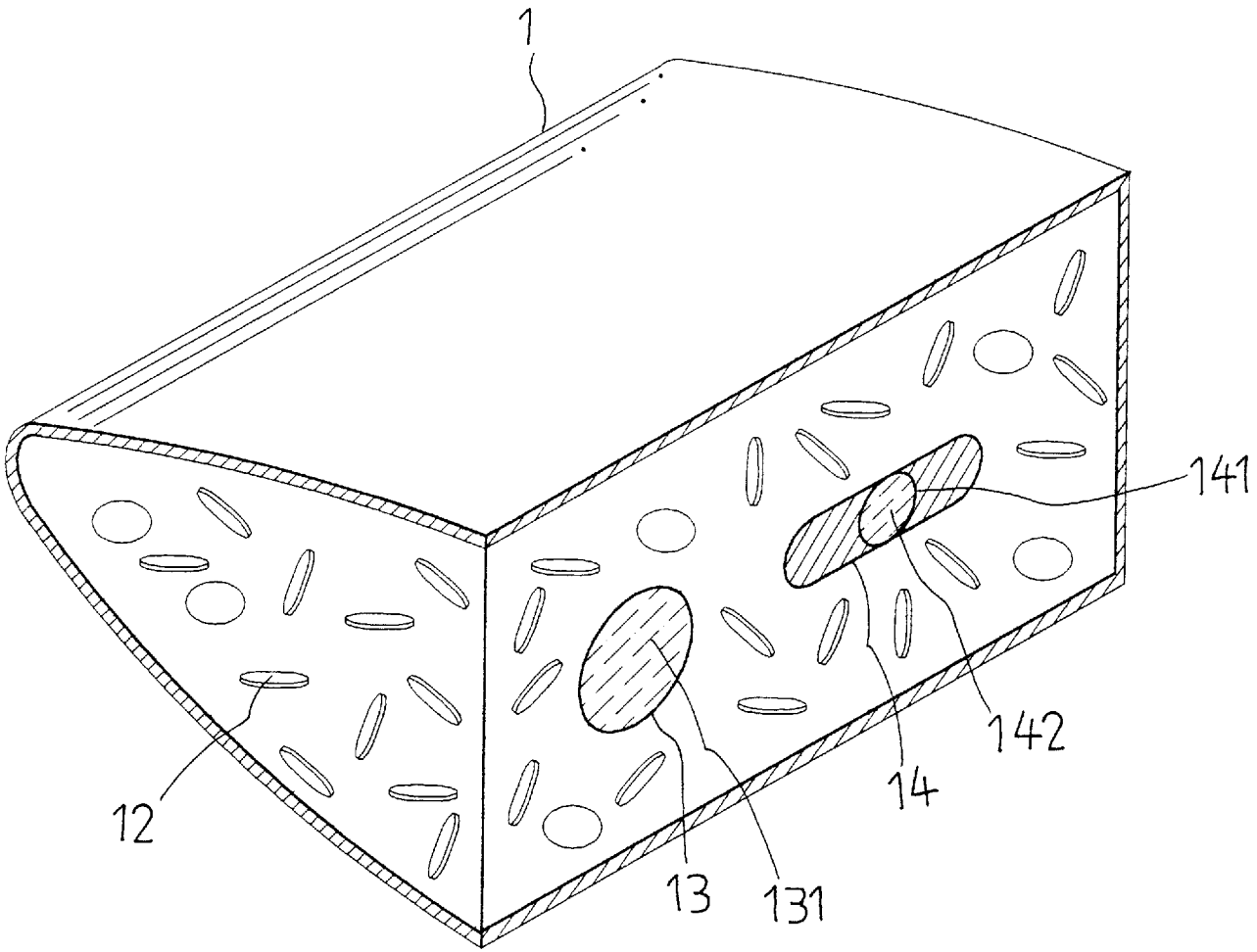
FIG. 4 is a partially sectional assembly view of FIG. 1.
Figure 5:
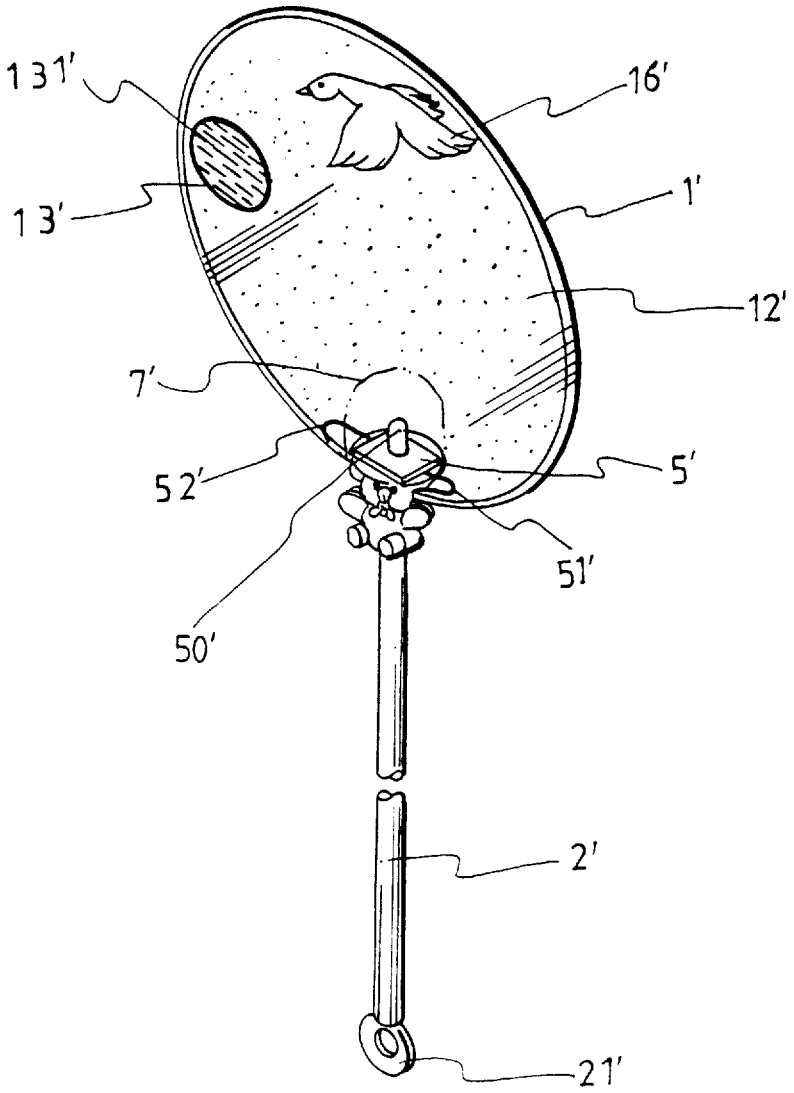
FIG. 5 is a partially sectional view of FIG. 2.

Referring to FIG. 4, a plurality of baking soda troches 12 are disposed in the main body 1. A film bag 13 is disposed in the main body 1. The film bag 13 contains an acidic solution 131. A plastic bag 14 is disposed in the main body 1. The plastic bag 14 has a transparent film 141. The plastic bag 14 contains a luminous liquid 142.

Figure 6:
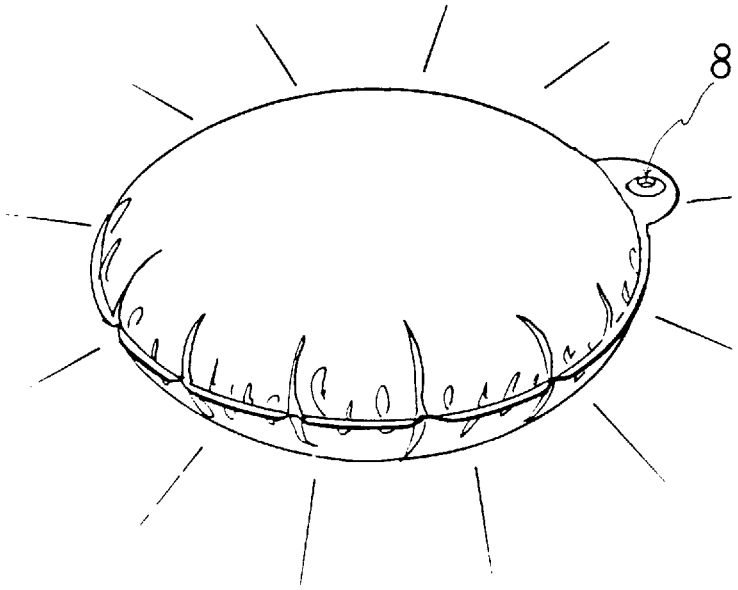
FIG. 6 is a perspective view of an inflated main body of FIG. 1.

The user can squeeze the main body 1 to break the film bag 13 and the transparent film 141. The luminous liquid 142 will flow out of the plastic bag 14. The acidic solution 131 will flow out of the film bag 13 to react with the baking soda troches 12. Carbon dioxides are produced by the reaction of the acidic solution 131 and the baking soda troches 12 to expand the main body 1 (as shown in FIG. 6).

Figure 7:
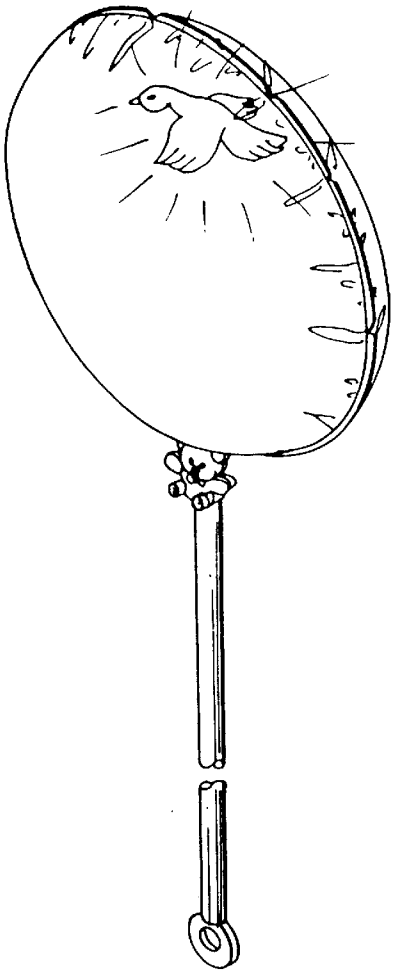
FIG. 7 is a perspective view of an inflated and luminous main body of FIG. 2.

Referring to FIGS. 2, 5, 7 and 8, a second portable luminous toy comprises a support rod 2' and a hollow main body 1' connected to the support rod 2'. The main body 1' has a pattern 16'. The support rod 2' has a distal end 21' disposed on a first end of the support rod 2', and a light-emitted diode 50' and a luminous circuit 5' disposed on a second end of the support rod 2'. A plurality of baking soda troches 12' are disposed in the main body 1'. A film bag 13' is disposed in the main body 1'. The film bag 13' contains an acidic solution 131'. A first wire 51' and a second wire 52' are connected to the luminous circuit 51'. A gel 7' encloses the first wire 51' and the second wire 52'. The main body 1' covers the light-emitted diode 50', the luminous circuit 5', and the gel 7'. When the user squeezes the main body 1' to break the film bag 13', the acidic solution 131' will flow out of the film bag 13' to react with the baking soda troches 12'. Carbon dioxides are produced by the reaction of the acidic solution 131' and the baking soda troches 12' to expand the main body 1' (as shown in FIG. 7). The residual acidic solution 131' becomes the conductive solution to conduct the first wire 51' and the second wire 52'.

Figure 8:
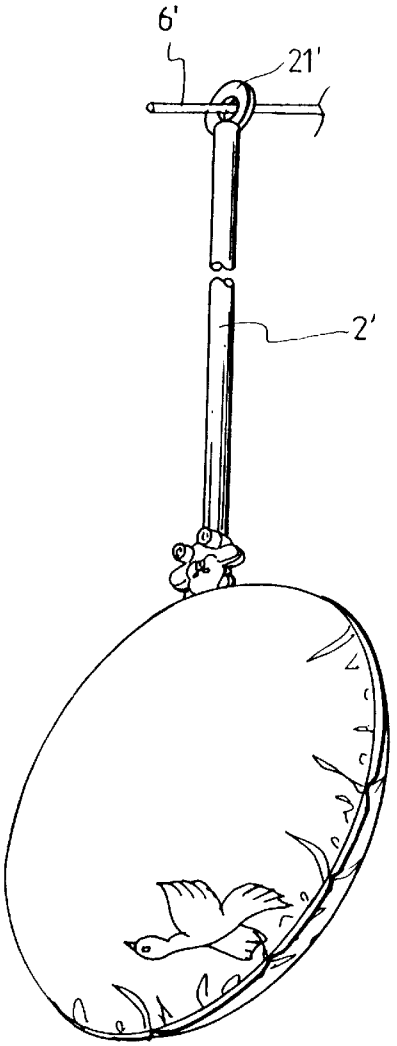
FIG. 8 is a perspective schematic view illustrating a distal ring of FIG. 2 hung on a bar.

Referring to FIG. 8, the distal end 21' receives a bar 6'. Thus the rod 2' is hung on the bar 6'. The residual acidic solution 131' will not conduct nor contact the first wire 51' and the second wire 52'.

The user can easily control the illumination of the light-emitted diode 50' by turning the portable luminous toy upside down or holding the portable luminous toy upright. The quantity of the baking soda troches 12' is easier controlled than the quantity of the baking soda solution.

The invention is not limited to the above embodiment but various modification thereof may be made. Further, various changes in form and detail may be made without departing from the scope of the invention.

I claim:

1. A portable luminous toy comprises:

a support rod having a distal end disposed on a first end of the support rod, and a first end cover and a second end cover disposed on a second end of the support rod, a hollow main body connected to the support rod, the main body having a lug, the lug having a through hole, the first end cover coupling with the second end cover, the first end cover having a post, the second end cover having a center hole, a hollow rivet inserted in the center hole via the through hole, the post inserted in the hollow rivet and the center hole, a plurality of baking soda troches disposed in the main body, a film bag disposed in the main body, and the film bag containing an acidic solution.

2. A portable luminous toy as claimed in claim 1, wherein a plastic bag is disposed in the main body, the plastic bag has a transparent film, and the plastic bag contains a luminous liquid.

* * * * *